United States Patent [19]

Evans

[11] 4,139,920

[45] Feb. 20, 1979

[54] POLYMORPHIC SUPPORT SYSTEMS

[76] Inventor: Franklin T. Evans, Homewood Rd., Ferry Farms, Annapolis, Md. 21402

[21] Appl. No.: 800,831

[22] Filed: May 26, 1977

Related U.S. Application Data

[63] Continuation-in-part of Ser. No. 650,353, Jan. 19, 1976, Pat. No. 4,055,866.

[51] Int. Cl.[2] ..... A47C 3/00; A47C 27/08

[52] U.S. Cl. ..... 5/367; 5/352; 5/357; 5/91

[58] Field of Search ..... 5/337, 338, 341, 352, 5/345, 334, 367, 357, 91

[56] References Cited

U.S. PATENT DOCUMENTS

| | | | |
|---|---|---|---|
| 395,043 | 12/1888 | Doremus | 5/341 |
| 1,212,515 | 1/1917 | Leavitt | 5/338 |
| 2,547,840 | 4/1951 | Smith | 5/352 |
| 3,459,179 | 8/1969 | Olesen | 5/345 R |
| 3,616,171 | 10/1975 | Hoskinson | 5/337 |
| 4,011,611 | 3/1977 | Lederman | 5/361 B |

*Primary Examiner*—Victor N. Sakran

*Attorney, Agent, or Firm*—Fidelman, Wolffe & Waldron

[57] ABSTRACT

A polymorphic body support system wherein the surface which engages the body is provided by a plurality of support elements to effect a contour support to the person thereon. Each support element is a closed flexible bag partially filled with a plurality of beads characterized as non-absorbent, non-compressible and capable of free flow with respect to each other within said bag when subjected to the weight of a body member. Varying degrees of bag filling produce varying support characteristics.

3 Claims, 4 Drawing Figures

POLYMORPHIC SUPPORT SYSTEMS

BACKGROUND OF THE INVENTION

This application is a continuation-in-part of my application Ser. No. 650,353, filed Jan. 19, 1976 for Polymorphic Support Systems, now U.S. Pat. No. 4,055,866.

1. Field of the Invention

This invention relates to a body support system and more particularly to a support which is useful in articles such as seats, beds and the like.

2. Description of the Prior Art

Conventional body support devices like seats and mattresses are stuffed with either natural materials such as chaff, straw, millet, kapok or synthetic material such as foams of polystyrene, polyurethane or rubber. The natural "fills" over a period of time from repeated compression and/or adsorption of fluids lose their resiliency and are difficult to clean and sanitize. While synthetic materials are more sanitary and are not moisture retaining the solid monlithic fills made from these synthetic materials are soft, resilient and deformable. These synthetic fill materials have not produced satisfactory comfort to the user. Another drawback for conventional synthetic monolithic fills is that they do not permit ventilation, thereby, causing discomfort to the user by insulating body heat. Other forms of synthetic material have been used as fill e.g., flakes, granules, pellets and powders to provide cushioning devices. A typical example of one such cushioning device is commonly referred to as a "bean bag." A "bean bag" assembly is generally filled with soft and compressible polystyrene foam pellets which lose their spongy resilience after a period of use. As a result, the bean bag gradually collapses, the pellets lose their ability to flow and redistribute under the weight of a body thereby, decreasing the comfort of the user. The present invention substantially overcomes the above mentioned shortcomings of the prior art body cushioning devices by providing a unique body support system with a fill of non-absorbent and non-compressible flowable particles.

Other natural "fills" not mentioned above are air and water. Water beds of one type or another have long been used by hospitals for the treatment of patients having varying problems such as bedsores and skin burns. Like the present invention, the primary advantage of the water bed is that it uniformly distributes the body weight so that the entire body surface in contact with the mattress is evenly supported thus avoiding uncomfortable pressure points unavoidable with conventional innerspring mattresses. A major disadvantage is the substantial weight of water beds. A filled double-sized mattress, for example, weighs between 1500–2000 pounds. Because of this substantial weight of water, great stresses are placed upon the mattress sidewalls creating potential for rupture of the water-tight envelope. These deficiencies of weight and possibility of leakage limit the location of use for water beds. Another disadvantage is the oscillating wave action caused by a person's movement on the bed. While this wave action only lasts for a matter of seconds, it echos or reverberates completely through the bed.

Still another problem occurs with water beds when there is a substantial weight difference between two persons. The heavier person will sink in the mattress while the lighter person will hardly make an indentation on the support surface. The body support system of the present invention alleviates all of the above noted problems associated with water beds. For example, the solid, non-absorbent and non-compressible beads fill cannot leak in the liquid sense of the word and make the bed useless. While the beads of this invention have flowable properties of a liquid when subjected to external force the beads would not generate the oscillating wave action of water. Furthermore, the problem of weight differential is overcome, since each body weight makes its own impression by bead displacement in each individual bag. At the same time the lateral force component is absorbed by adjacent flexible bags. The net effect is individual comfort in a double-size bed.

Gas-inflatable mattresses and cushions have long been articles of commerce. Air mattresses have found wide utility as sleeping bags. However, with the conventional air mattress, which is placed upon an irregular surface such as the earth, the inflation pressure must be great enough to support the load above the highest irregularity in the surface. This requirement generally necessitates having some sort of air pump or equivalent device for inflating the mattress, and results in a support which has very little give and which easily transmits shock to the body which is being supported. All current designs of air mattresses incorporate at least one, and generally both, of the above-mentioned limitations of excessive firmness and the requirement of providing for high pressure. The solid particles of this invention obviate these deficiencies associated with air and other gas filled mattresses. First, there is no inflation pressure required. Second, the particles operate by body displacement in a manner similar to a liquid rather than by gas expansion principles which result in an uncomfortable "pushing back" against the body weight.

SUMMARY OF THE INVENTION

The present invention relates to a polymorphic body support system comprising a base structure being dimensioned to receive a person thereon, a plurality of support elements contiguously arranged on the base structure defining a generally planar supporting surface. Each of the support elements is comprised of a closed flexible bag containing a plurality of beads. These beads are characterized as non-absorbent, non-compressible and capable of free flow with respect to each other within the bag when subjected to the weight of a body member. Thus when the system is subjected to a person's weight, the particles on the upper surface of the bag conform to the body member supported thereon. Each of the contiguous flexible bags is independently responsive to the compressive force component resulting from the presence of the body member and jointly responsive to the force components to provide a comfortable contour support for the person. The bags are filled in varying degrees to provide varying support characteristics.

Thus, it is the principal object of the present invention to provide a maximal body comfort by evenly distributing body contact pressures.

Another principal object of this invention is to provide a body support system having internal relatively hard elements which provide the needed rigidity for orthopedic purposes, a soft surface to avoid bruises, abrasions or other similar damage to the skin of the user and yet is comfortable for sleeping or lounging purposes.

A still further object of this invention is to provide a body support system which can be used in a great variety of shapes and forms without compromising the desired comfort.

DESCRIPTION OF THE PREFERRED EMBODIMENTS

Figure 1:
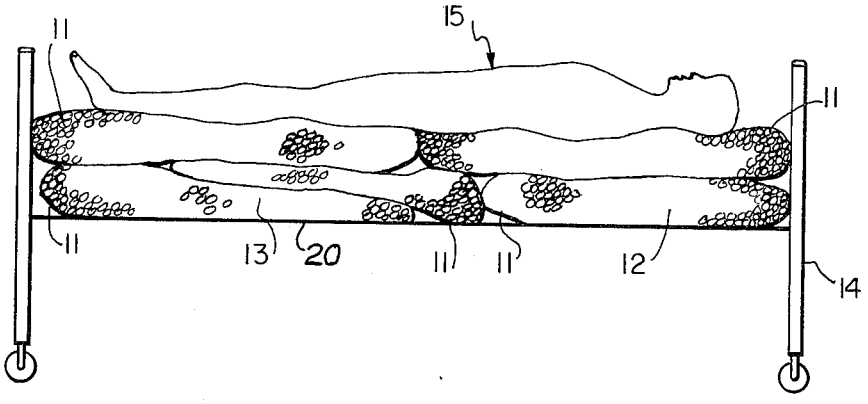
FIG. 1 is a side view elevation partly cutaway in cross-section of one embodiment of this invention showing a plurality of support elements which are depressed under the weight of a body in order to form a supporting surface conforming to the body contour.

A typical polymorphic body support system of this invention is shown in FIG. 1. The body support system is comprised of a plurality of support elements comprising closed flexible bags 11 manufactured from any natural or synthetic soft textile material 12 which are filled with a plurality of hard, non-absorbent and non-compressible flowable beads 13. The plurality of bags 11 are placed in contiguity to each other on a conventional bedstead having a horizontal supporting surface 20 as a suitable supporting structure.

In FIG. 1 there is shown a body support system according to the present invention with a plurality of support elements as represented by flexible bags 11 which are depressed under the weight of body 15. As illustrated when the weight of the body 15 is brought to bear on the flexible bags 11, the beads 13 being capable of free flow with respect to each other within the bag flow out of the volume displaced by the body 15. The constraint on the lateral force component provided by the flexible bag and adjacent bags or retainer walls (not shown) causes the beads to to be displaced in generally upward direction surrounding the body 15 so as to permit the upper surface of the supporting elements to conform to the body member thereon. In effect this increases the amount of vertical or compensatory support over a larger load area eliminating pressure points and provides a comfortable contour support. When a person sits or reclines on the body support system of this invention, the beads 13 are displaced from the volume of space occupied by the user's body 15 and they flow into unoccupied portions within the interior of the bag 11. The flow and redistribution of the beads 13 enable the body support elements 11 both to conform to the contours of the user's body. Each support element is independently responsive to the compressive force component of the respective body number thereon and jointly responsive to the lateral force components with adjacent flexible bags in the same plane. The result is a highly comfortable means for reclining or sitting. For most sleepers, this would provide an extra measure of comfort. For invalids, the body support system of this invention provides a more uniform distribution of weight which avoids deleterious concentrations of supporting force that contributes to the development of bedsores or decubitus ulcers.

Surprisingly, the hard non-absorbent and non-compressible flowable beads which provide the needed internal structural rigidity and orthopedic support also provide a comfortable sleeping environment. Any solid material which has the property of free flow with respect to each other within the closed flexible bag when subjected to an external pressure is suitable as a bead composition. Physical properties which enhance the free flow characteristic of the bead are desirable. For example, the beads should be smooth and be non-compressible to the extent that they do not deform when subjected to body weights within the human range. In most cases beads having compressive strength of at least 300 pounds per square inch are satisfactory. Technically there is no upper limit to the compressive strength parameter as the flowable bead filter. Suitable materials include metals, metal alloys, glass, ceramics, and plastics including thermoplastic and thermoset resins. The metals and metal alloys include both ferrous and nonferrous compositions e.g., steel, brass, bronze or copper ball bearings.

Suitable thermoplastic resins are the acrylonitrilebutadiene-styrenes (ABS), acetals, acrylics, cellulosics, chlorinated polyethers, fluoro-olefins, polyamides, phenylene oxide resins, polycarbonates, polyolefins, polyamides, polyphenylene sulfides, vinyl aromatics, polysulfones, polyvinyl halides and polyvinylidene halides. Specific examples of the above thermoplastic polymers are polymethyl methacrylate, cellulose acetate butyrate, chlorinated polyether, polytetrafluoroethylene polychlorotrifluoroethylene, ethylene-propylene, copolymers nylon-6, 6, high density polyethylene, polypropylene, solid polystyrene, polysulfone, polyvinyl chloride and vinyl chloride-vinylidene copolymer.

Suitable thermoset resins are the allylics, amino, epoxies, furfural alcohol polymers, phenolics, silicones, polyesters, urethanes and vinyl esters.

Specific examples of the above thermoset resins include diallyl phthalate, diallyl isophthalate, formaldehyde-urea, formaldehyde-melamine, furfural alcohol cured with isopropyl sulfuric acid or p-toluene sulfonyl chloride or p-toluene sulfonic acid and phosphoric acid, phenol-formaldehyde and polydimethylsiloxane.

Other useful non-absorbent and non-compressible bead fillers include metal nucleus coated with a thermoplastic or thermoset resins. For example, steel ball bearings coated with polyethylene or polyvinyl chloride or polytetrafluoroethylene are useful.

The fill beads can have any round configuration e.g., a sphere, cylinder, frustum, disc or toroid. In practice, it has been found that the size of the beads can be conveniently between 1 and 50 millimeters and preferably between 5 and 15 millimeters and most preferably between 1 and 5 millimeters in diameter. These size ranges insure that the beads readily adapt to the contours of the body. In another embodiment where the particles have a disc configuration, the thickness of the center is about ⅓ to 1/5 of the diameter, this thickness then tapers to a thin edge around the circumference of the disc. The preferred diameter of the disc is from 5 to 60 millimeters and most preferably between 5 and 25 millimeters. In a further embodiment, the disc can have the central section removed to yield a toroidal or doughnut shape. According to a further aspect of the present invention, it is preferable that particles of the same size and shape be used together. Although for specific purposes different sizes and shapes may be used together.

Each flexible bag component of this invention defines a unitary interior volume, each portion of the volume freely communicating with every other portion to allow uninhibited flow of the beads from space to space. The bag is usually constructed of soft breathable textile material, for example, a porous natural fabric such as cotton, wool, silk, juta, flax, lines, hemp, ramie or a synthetic fabric manufactured from a polyester polyacrylamide, nylon and rayon or blends of these materials i.e., cotton-polyester, silk-wool and the like or elastic textiles such as spandex and amidex. For more durable service but generally not for surface body contact layers, the bag can be manufactured from olefin fibers or films such as polyethylene or polyvinyl chloride.

The size and shape of the bag can be varied depending on the intended use. For bedding purposes the bag is generally of oblong tubular outline similar to a conventional pillow. In one embodiment, it is preferred that the overall body support system be made of a plurality of relatively small units as shown in FIG. 1. This arrangement of relatively small units not only provides ease of mobility but also allows for a wide spectrum of bed sizes and shapes which can be obtained by merely adding or subtracting units as required. In the production of the flexible bag component, the bag is filled to between 70 and 90 volume percent and fully sealed by conventional means such as heat sealing, stitching or with adhesives. When elastic textiles are used such as spandex or amidex the bag in its relaxed state is filled to about 90 to 100 volume percent and preferably about 95 volume percent.

According to this invention a plurality of flexible bags can be used with or without a retainer. The retainer can be made from metal, plastic or wood and can be of varied sizes and designs. For example, it can be a conventional bedstead, a sandbox or it can be a natural cavity i.e., a hole in the ground. The support elements or flexible bag assembly can also be used without a retainer or a support structure for such uses as a body support for station wagons and camper trucks. For sleeping bags and camping use the flexible bag assembly can be placed on any irregular or inclined surface yet it provides a well stabilized relatively shock-insenstive and comfortable load-bearing area. The beads will fill the volume of the irregular bottom in a fluid-like manner to provide a generally planar surface. Along that surface the pressure is equalized and the irregularities of the bottom are not transmitted to the surface level. Another advantage over the conventional mattress system is that the flexible bag assemblies of this invention are easily removed, are washable and dry readily. The bag assemblies can be cleaned with readily available laundry equipment. This is particularly useful for hospitals and nursing homes who care for patients who are incontinent and have draining lesions.

In an alternative embodiment of this invention elastic bags e.g. those made using a fabric such as spandex are filled in the range of 20 to 50% with fill beads. Bags filled only to this lesser degree exhibit special characteristics not found in or possible with bags filled in the 70 to 100% fill range as described above.

Empty elastic bags have a shape without stretching; an elastic bag which is 90% filled contains a volume of pellets which just extend the bag to its minimal "full" volume with only slight stretching of the fabric beyond its minimal set. A bag filled to that level tends to assume its own shape, that is a rectangular empty bag when 90% filled takes on the shape of a rectangular pillow having depth, but in plane view still appearing as a rectangle. When distorted the 90% filled (and more filled) bag tends to retain and return to its undistorted shape. For example, the 90% filled rectangular bag after distortion tends to return to the rectangular pillow shape.

Less filled bags have less tendency to return to their original undistorted shape. A 20% filled bag (or less filled), laid flat, can be put into almost any shape and will not return to the basic shape of the cloth material. Thus a rectangular bag only 20% filled can be pushed into almost any shape which will be retained until a new shape is imposed. The bag is wilted rather than plump.

Basically in the more filled bags there is a slight tension tending to pull the pellets into a more or less cohesive single mass. In the less filled bags, the pellets are free to move apart in various directions. When an object is impressed upon the more filled bag, there is a slight tendency from the outset to extrude and to elastically resist penetration. The less filled bags on the other hand will accept an impressed object without counterpressure until the volumes of the pellets and the intruding object combine to create some tension in the fabric and a resistance to further penetration.

But the less filled bag has dual characteristics not possible with the more filled bag. With a less filled bag one can isolate the pellet mass, for example, in one half, fold over the excess cloth and roll the whole into a unit now with the characteristics of the more filled bag. Thus the less filled bag may be arranged to have either characteristic reversibly, e.g. a 20% or 90% filled characteristic. The less filled bags, e.g. 20–50% can be arranged to resist intrusion to a greater or lessor degree from zero to a maximum by rolling or folding the bag into progressively tighter patterns. The more filled bag, e.g. 70–90% can be varied to a lesser degree but its resistance to intrusion can never be reduced to zero in any arrangement.

Figure 2:
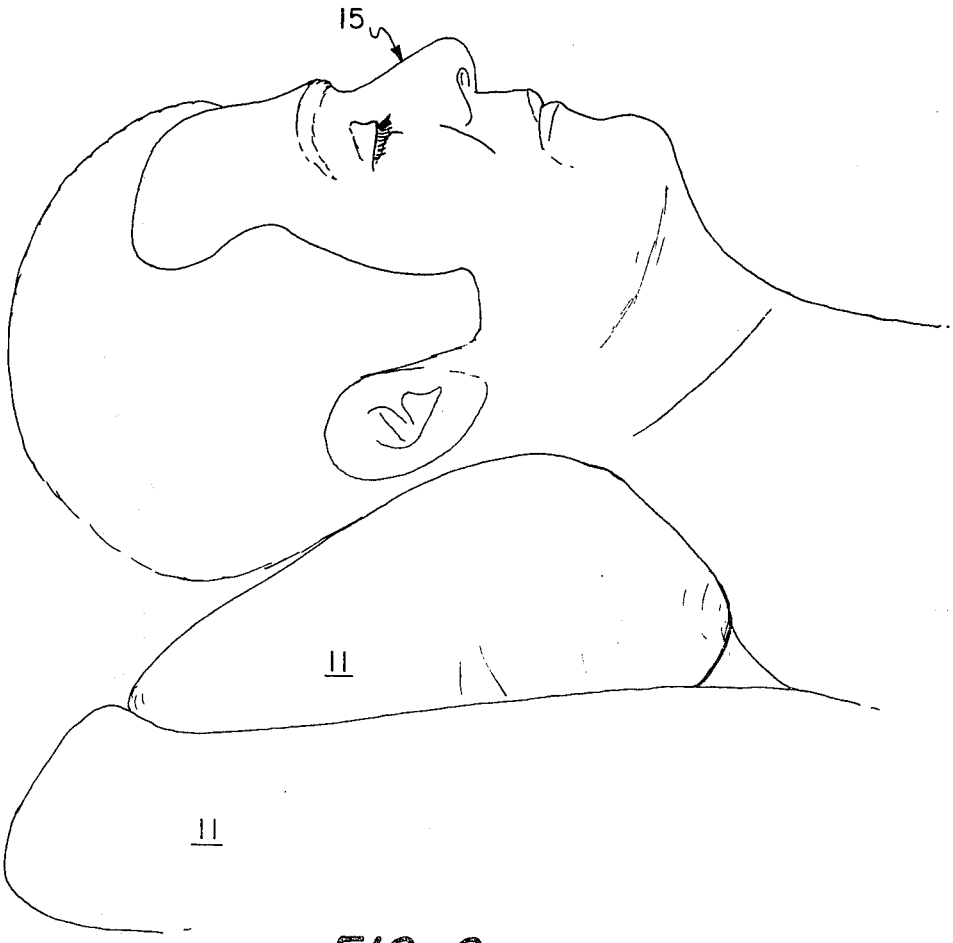
FIGS. 2, 3 and 4 are side elevations to an enlarged scale showing bags of this invention with varying degrees of fill providing head support.
Figure 3:
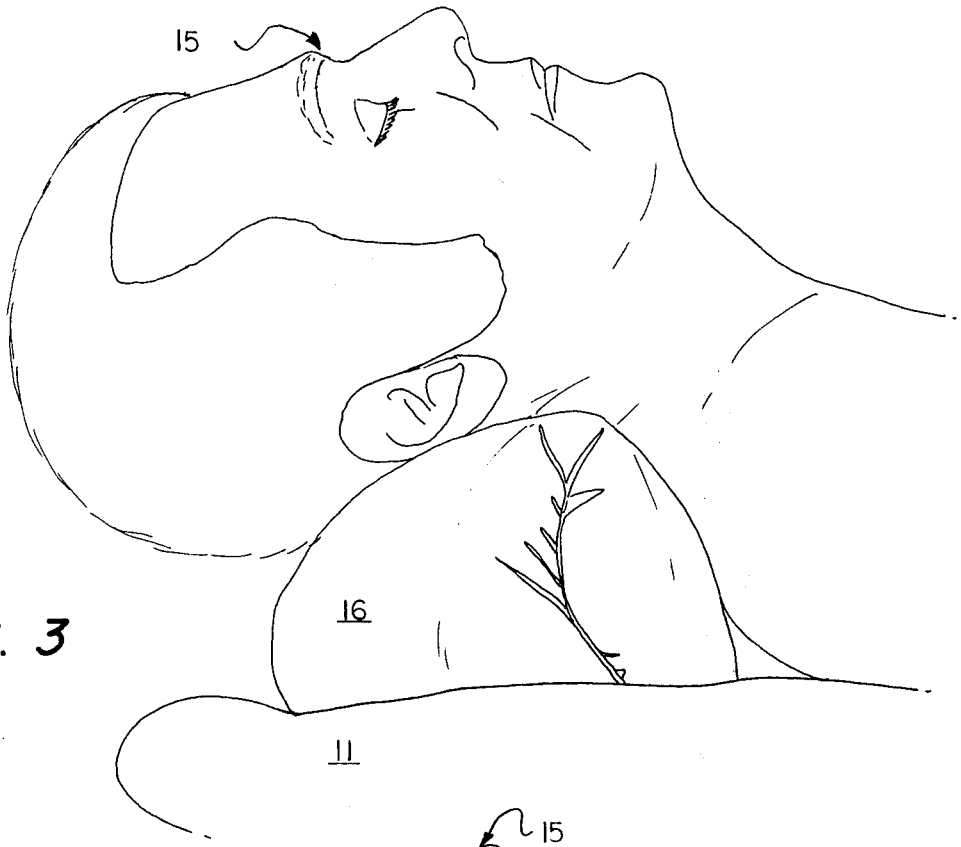
Figure 4:
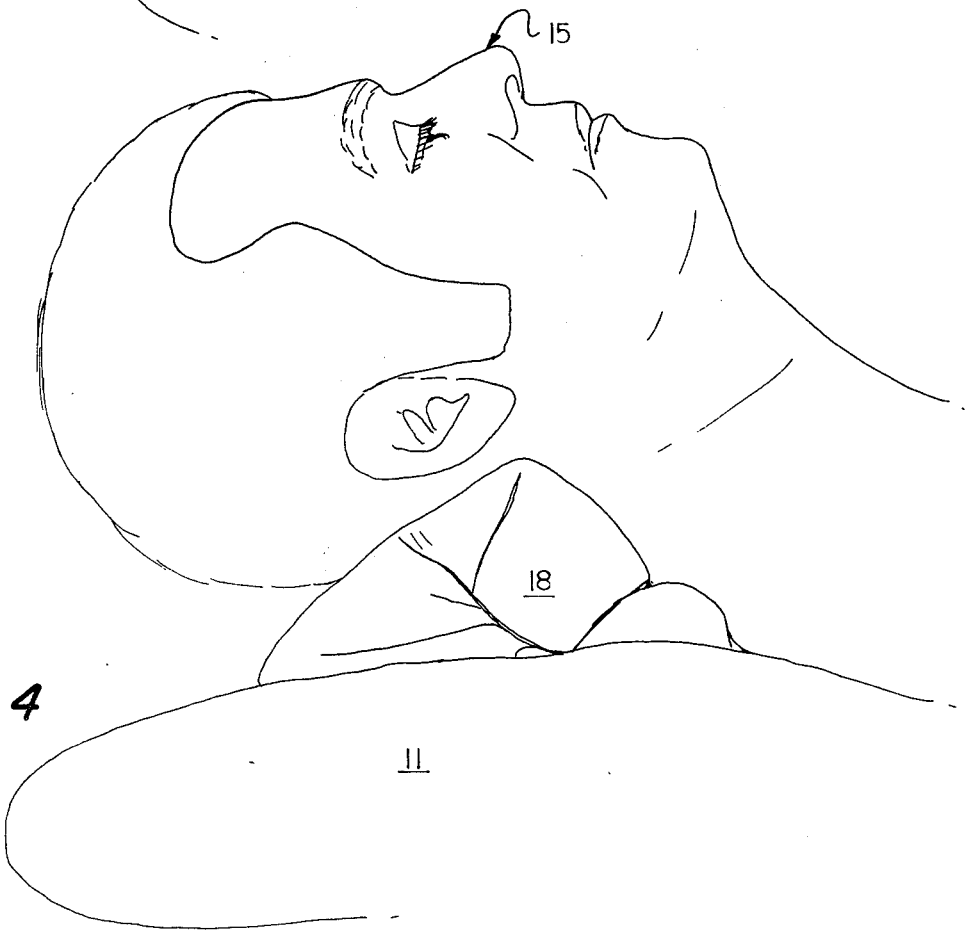

The ability to reshape the 20 to 50% filled bag is especially advantageous in the polymorphic support system of this invention in providing body support in zones of tight contour changes, for example, between the shoulders and base of the head. FIGS. 2, 3 and 4 illustrate respectively the use of approximately 90%, 70% and 20% filled bags for such an application. In FIG. 2 the man 15 is shown with the base of his head supported on a 90% filled bag 11 which is one of many comprising a support system of this invention (as in FIG. 1). The bag 11 is unfolded. In FIG. 3 the head of the man 15 is supported on a bag 16 filled approximately 70%. One fold in the bag 16 compacts the beads and retains them in an elastic wedge of localized support. In FIG. 4 the head of the man 15 is supported on a bag 18 filled 20% with beads and folded many times until the desired contour and degree of elastic support is achieved.

In an embodiment, bags filled 70–90% may be used for the major support areas, as illustrated in FIG. 1, supplemented with folded 20–50% filled bags in the close zones, e.g., at the base of the head as previously described and illustrated. In an alternative embodiment 20–50% filled bags may be folded in varying degrees to comprise the entire support system of this invention. In actual use, folded 20–50% bags in tight contour zones, e.g., at the base of the head, have provided excellent vertical support while at the same time providing a slight tractive effect due to the elastic resistance of the bag to intrusion.

What is claimed:

1. A polymorphic body support system comprising a base structure including a generally planar supporting surface dimensioned to receive a person thereon, a plurality of unattached, individual closed flexible and expandable bags contiguously arranged on said base structure, said contiguous arrangement including at least a single layer of said expandable bags, said expandable bags being filled to between 20–50 volume percent with said beads, said contiguous arrangement between said unattached, individual bags and the quantity of said bags being infinitely variable, at the discretion of the user prior to or during use, at least some of said bags being folded over to increase the resistance of said folded bags to intrusion by the body of said person, each of said bags containing a plurality of beads, said beads being characterized as non-absorbent, non-compressible and capable of free flow with respect to each other within said bag when subjected to the weight of a body member so that the upper surface of the bag conforms to the body member supported thereon, each of said contiguous flexible bags being independently responsive to the compressive force component resulting from the presence of the body member and jointly responsive to the lateral force components to provide a comfortable contour support for the person.

2. A polymorphic support system of claim 1 further comprising bags in the range of 70–90 volume percent filled with said beads.

3. A polymorphic support system of claim 2 further comprising a plurality of layers of said bags.

* * * * *